US007806280B1

(12) United States Patent
Perkins et al.

(10) Patent No.: US 7,806,280 B1
(45) Date of Patent: Oct. 5, 2010

(54) PORTABLE CLOTHES HANGING ROD

(76) Inventors: Roger A. Perkins, 3980 S. Peggy Ave., Pahrump, NV (US) 89048; Marvin E. Perkins, 3980 S. Peggy Ave., Pahrump, NV (US) 89048

( * ) Notice: Subject to any disclaimer, the term of this patent is extended or adjusted under 35 U.S.C. 154(b) by 284 days.

(21) Appl. No.: 11/888,533

(22) Filed: Aug. 1, 2007

(51) Int. Cl.
*A47H 1/00* (2006.01)
*A47F 5/00* (2006.01)
*A47G 29/00* (2006.01)

(52) U.S. Cl. ..... 211/100; 248/353; 248/240; 248/291.1

(58) Field of Classification Search ..... 211/1.3, 211/96, 98, 99, 100, 104, 105.1, 119.1, 123, 211/165, 171, 172, 97, 101, 102; 248/291.1, 248/294.1, 298.1, 353, 629
See application file for complete search history.

(56) References Cited

U.S. PATENT DOCUMENTS

| | | | | | |
|---|---|---|---|---|---|
| 110,607 | A | * | 12/1870 | Tredenick | 211/100 |
| 342,954 | A | * | 6/1886 | Ertell | 211/99 |
| 660,316 | A | * | 10/1900 | Shoenberg | 248/294.1 |
| 674,586 | A | * | 5/1901 | Riley | 108/16 |
| 852,894 | A | * | 5/1907 | McCoy | 211/100 |
| 930,406 | A | * | 8/1909 | McDonald | 294/5.5 |
| 975,273 | A | * | 11/1910 | Noppe | 211/97 |
| 978,423 | A | * | 12/1910 | Zizinia | 211/99 |
| 984,556 | A | * | 2/1911 | Gehrke | 211/165 |
| 1,072,089 | A | * | 9/1913 | Connelly | 312/6 |
| 1,352,556 | A | * | 9/1920 | Soule | 211/104 |
| 1,353,287 | A | * | 9/1920 | Stein | 211/99 |
| 1,361,739 | A | * | 12/1920 | Matheson | 211/99 |
| 1,367,629 | A | * | 2/1921 | Shoemaker | 211/104 |
| 1,373,460 | A | * | 4/1921 | Striker et al. | 211/99 |
| 1,471,328 | A | * | 10/1923 | De Grasse | 211/99 |
| 1,522,873 | A | * | 1/1925 | Doering | 211/99 |
| 1,529,053 | A | * | 3/1925 | Bried | 211/99 |
| 1,892,687 | A | * | 1/1933 | Teufel | 211/99 |
| 2,099,495 | A | * | 11/1937 | Mirel | 211/97 |
| 2,142,830 | A | * | 1/1939 | Wendell | 211/100 |
| D128,287 | S | | 7/1941 | Lauronen | |
| 2,268,894 | A | * | 1/1942 | Ogren | 211/100 |
| 2,341,210 | A | * | 2/1944 | Dahleen | 248/205.1 |
| 2,429,041 | A | * | 10/1947 | Anderson | 211/100 |
| 2,587,111 | A | * | 2/1952 | Cashen, Jr. | 211/1.3 |

(Continued)

FOREIGN PATENT DOCUMENTS

| | | | | |
|---|---|---|---|---|
| GB | 2055572 | A | * | 3/1981 |

*Primary Examiner*—Darnell M Jayne
*Assistant Examiner*—Joshua Rodden
(74) *Attorney, Agent, or Firm*—Montgomery Patent and Design; Robert C. Montgomery; Joseph T. Yaksich

(57) ABSTRACT

A deployable rod for hanging clothes after removal from a dryer. The apparatus is a circular rod with a hinge mechanism that is attached to a vertical wall surface. In a retracted state, it folds compactly up against the wall. In a deployed state, it extends perpendicularly outward. The apparatus is supported in the extended outward position by a cable that extends from the outer end back to the wall surface at a 45° angle. This cable support system provides strength for holding clothes. A user could remove clothes from a dryer, immediately place them on hangers and then hang them from the employed apparatus in the extended position; however, other articles may be supported in this manner.

10 Claims, 2 Drawing Sheets

U.S. PATENT DOCUMENTS

| | | | | | |
|---|---|---|---|---|---|
| 2,662,645 | A | * | 12/1953 | Piton | 108/135 |
| 2,875,903 | A | * | 3/1959 | Shourds | 211/100 |
| 3,211,295 | A | * | 10/1965 | Weiss | 211/100 |
| 3,941,250 | A | * | 3/1976 | Ott | 211/1.3 |
| 4,051,953 | A | * | 10/1977 | Shoaf | 211/119.1 |
| 4,094,414 | A | | 6/1978 | Thiot et al. | |
| 4,103,781 | A | | 8/1978 | Sterling | |
| 4,154,545 | A | * | 5/1979 | Pinto et al. | 403/104 |
| 4,171,748 | A | | 10/1979 | Fabian | |
| D259,228 | S | * | 5/1981 | Fabian | D6/324 |
| D261,704 | S | | 11/1981 | Parker | |
| D271,546 | S | * | 11/1983 | Smith | D6/324 |
| D276,195 | S | * | 11/1984 | Smith | D6/324 |
| 4,632,255 | A | * | 12/1986 | Kennedy | 211/1.3 |
| 4,775,056 | A | * | 10/1988 | Inglis | 211/105.3 |
| 4,819,812 | A | | 4/1989 | Demarest, Jr. | |
| 5,019,126 | A | * | 5/1991 | Post | 211/104 |
| 5,181,685 | A | | 1/1993 | Ostapowicz | |
| 5,228,202 | A | * | 7/1993 | Liao | 30/249 |
| 5,284,260 | A | | 2/1994 | Caligiuri, Sr. | |
| 5,405,065 | A | | 4/1995 | Olson | |
| 5,417,511 | A | * | 5/1995 | Warden | 403/109.5 |
| D359,379 | S | * | 6/1995 | Haviland | D26/140 |
| 5,950,882 | A | | 9/1999 | Scott | |
| D414,625 | S | | 10/1999 | Stelmarski | |
| 6,045,284 | A | * | 4/2000 | Chiu | 401/289 |
| 6,464,091 | B1 | | 10/2002 | Nagasaki | |
| D507,072 | S | * | 7/2005 | Gantenbrink et al. | D26/140 |
| D516,240 | S | * | 2/2006 | Gantenbrink et al. | D26/140 |
| 7,234,603 | B1 | * | 6/2007 | Harris et al. | 211/100 |

* cited by examiner

PORTABLE CLOTHES HANGING ROD

FIELD OF THE INVENTION

This invention relates to clothes hangers and, more particularly, to an adaptable clothes hanger for use during and after laundry procedures.

BACKGROUND OF THE INVENTION

Doing laundry is perhaps one of the most hated chores performed in households. The gathering, sorting, washing, drying, folding, ironing and returning of the clean clothes to their storage location is a difficult, time consuming, and ever-repeating task. In most instances, laundry areas are not located right next to storage closets. In such instances, when clothes are removed from the washer, the user is typically forced to put the clothes in a basket, spread them out on top of the washer or dryer, or hang them on the back of a chair. None of these solutions are ideal, as the clothes tend to get more wrinkled, perhaps get dirty, or make the laundry area look unorganized or unattractive. The same problems are encountered when ironing clothes away from a closet area as well.

Several attempts have been made in the past to provide a means for conveniently hanging clothes outside of a closet during laundry procedures. U.S. Pat. No. 4,171,748 in the name of Fabian discloses a foldable hanger assembly for mounting on a wall. The assembly includes an elongated housing to which is pivotally connected a hanger arm that is stored in the housing when not in use. The hanger arm is dropped to a horizontal position for supporting clothes hanger or the like and a brace is hingedly positioned at one end on the hanger arm and the opposite end thereof is slidably engaged with the housing at a point intermediate its length. Unfortunately, this prior art example is not portable and requires a large amount of wall space for mounting.

U.S. Pat. No. 5,405,065 in the name of Olson discloses a portable clothes hanger to suspend articles of clothing for drying, displaying, or storing purposes. The hanger includes a center support member which may be suspended from a shower curtain rod, a door, or other fixture. A base is coupled to the lower end of the center support member and a plurality of arms are pivotally coupled around the base. The arms may be positioned in a parallel relationship with the center support member for travelling or storage, or pivoted into a nearly horizontal, radially extending position such that articles of clothing and the like may be draped over each arm. A pair of clips are slidably disposed on each arm and are operable to secure such articles to their respective arms. Unfortunately, this prior art example consumes a lot of space in both an open and a closed position.

U.S. Pat. No. 4,819,812 in the name of Demarest describes a self-contained, portable dryer for use in drying articles of clothing. The apparatus includes a hanger bar with telescoping segments for selective collapse and extension, and a plurality of hangers stored within the telescoping segments and retrievable from within the hanger bar for erection and suspension from the hanger bar in one of two selectable configurations to accommodate the various articles of clothing ordinarily washed or rinsed out by travelers and hung out to dry at facilities available to such travelers. Unfortunately, this prior art example is not provided with a means for easy installation.

None of the prior art particularly describes a portable clothes hanging rod for use during and after laundry procedures. Accordingly, there exists a need for a means by which laundry on hangers can be temporarily hung in an easily accessible location without the disadvantages as described above. The present invention satisfies such a need by providing an apparatus that is convenient and easy to use, lightweight yet durable in design, and designed for hanging clothes outside of a closet. The portable clothes hanging rod provides a means for a wall-mounted apparatus that can be folded down in order to hang clothes straight out of the dryer to keep them wrinkle-free until they can be stored in a closet. The present invention is simple to use, inexpensive, and designed for many years of repeated use.

SUMMARY OF THE INVENTION

In view of the foregoing disadvantages inherent in the prior art, it has been observed that there is need for a portable clothes hanging rod for use during and after laundry procedures.

The present invention is a deployable rod for hanging clothes in a laundry room after removal from a dryer. The invention utilizes a circular rod, envisioned to be approximately 1 foot long, but can vary in length per the application and needs. It is attached to a vertical wall surface by the use of hinge mechanism. In its retracted state, it is folded up against the wall such that it does protrude into the space. In its deployed state it is extended outward in a perpendicular manner. It is supported in this position by a chain that extends from the outer end back to the wall surface at a 45 degree angle. This support system provides strength for holding a multitude of clothes on hangers. To use the invention, the user removes clothes from the dryer, immediately places them on a hanger and then hangs them from the invention. When all clothes are removed, the entire group can be removed and stored in a closet, or pass on to the next step of ironing if required. The use of the present invention provides a handy helping hand on laundry day that keeps clothes clean, organized and neat without stacking them on top of the dryer or risking creasing in a clothes basket.

A portable clothes-hanging rod includes a rectilinear wall-mounted plate attached to a vertical support surface and a pair of tubular telescoping rods pivotally attached to the mounting plate. A first one of the pair of telescoping rods has a pair of diametrically opposed holes formed in an inner end thereof. The rod further includes a flexible cable with opposed top and bottom ends respectively. Such a top end of the cable is attached to the mounting plate while the bottom end of the cable is attached to the first rod of the pair of telescoping rods. The cable provides a support mechanism for holding the first and second rods respectively along the horizontal plane while supporting the weight of clothing and hangers thereon when the portable clothes-hanging rod is in the deployed state. The cable further extends between the storage clip and the rod bracket respectively. The clothes-hanging rod folds into a vertical position when in a retracted state and extends horizontally outward in a telescoping manner when in a deployed state. The clothes-hanging rod is supported in the deployed state by the cable extending from an outer end of the first rod of the pair of telescoping rods back to the mounting plate at a 45° angle to support existing clothing and hangers and other articles respectively thereon.

The portable clothes-hanging rod further includes a storage clip integrally attached to an inner surface of the mounting plate. Such a storage clip is located adjacent to a top end of the mounting plate and extends away therefrom. The storage clip includes a U-shaped clamp provided with a closed end connected directly to the inner surface of the mounting plate and has an open end extending outwardly and away from the closed end of the storage clip. Such an open end of the storage clip receives and captures the distal end of the second rod when the first rod and the second rod are simultaneously biased to the vertical position when the portable clothes-hanging rod is in the retracted state.

The apparatus further includes a pivot bracket integrally attached to the inner surface of the mounting plate. Such a pivot bracket is located adjacent to a bottom end of the mounting plate and has a pair of laterally opposed tabs extending outwardly therefrom. Each of such tabs has a bore formed therein, and each of such bores has a centrally registered axis oriented perpendicular to a longitudinal length of the mounting plate. The apparatus further includes a pair of cable crimps integrally attached to the respective top and bottom ends of the cable such that each of the crimps cooperates with each of the top and bottom ends respectively of the cable to form an upper cable loop and a lower cable loop respectively.

The apparatus further includes an eyelet bolt statically connected to the inner surface of the mounting bracket and extending away therefrom. Such an eyelet bolt is located subjacent to the storage clip, and the upper cable loop of the cable is slidably attached to the eyelet bolt. The apparatus further includes a rod bracket statically affixed to the outer surface of the first rod. Such a rod bracket is located adjacent to the outer end of the first rod, and the lower cable loop of the cable is removably attached directly to the rod bracket. Further, a rod clamping mechanism is rotatably attached to the outer surface of the outer end of the first rod.

The portable clothes-hanging rod further includes a second rod telescopically connected to the first rod. Such a second rod has a diameter that is less than a diameter of the first rod such that the second rod is telescopically interfitted within the first rod during non-operating conditions. The second rod is prohibited from prematurely and undesirably shifting during operating conditions via manipulation of the rod clamping mechanism. The apparatus further includes a plurality of clothes hanger grooves monolithically formed in an outer surface of the second rod and the outer surface of the first rod respectively. Such grooves are equidistantly spaced along respective longitudinal lengths of the first and second rods. Further, an end cap is removably interfitted over a distal end of the second rod such that the end cap prohibits the second rod from being completely interfitted within the first rod during non-operating conditions.

The apparatus further includes a pivot bolt removably and simultaneously penetrated through the bores of the tabs and the holes of the inner end of the first rod such that the inner end of the first rod is pivotally attached to the pivot bracket. The first and second rods respectively are simultaneously biased upwardly and downwardly respectively 45 degrees along an arcuate path defined by the pivot point of the pivot bracket. The first and second rods simultaneously reside along the vertical plane when in the retracted state and alternately simultaneously reside along the horizontal plane when in the deployed state. The apparatus further includes a plurality of fasteners for removably fastening the mounting plate to a vertical support surface and the storage clip and the pivot bracket respectively to the inner surface of the mounting bracket and the lower cable loop to the rod bracket respectively.

A method for installing and utilizing a portable clothes-hanging rod includes the steps of: locating an appropriate wall surface with an inclusive wall stud on which to secure a mounting plate; installing the mounting plate by penetrating a plurality of fasteners into the wall and stud; deploying a first rod by releasing and pivoting the first rod downward in a pivoting movement from a storage clip until a cable is taut; releasing a rod clamping mechanism by rotating a second rod one full turn in a counter-clockwise direction; extending the second rod outward in a lateral movement until obtaining a desired length; securing the position of the second rod by rotating the second rod one full turn in a clockwise direction; loading clothing and hangers onto the first rod and the second rod respectively by using clothes hanger grooves formed in outer surfaces of the first and second rods respectively; and storing the portable clothes-hanging rod after drying and removal of the clothing and hangers respectively by retracting and pivoting the first and second rods respectively to the vertical retracted state.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

| DESCRIPTIVE KEY | |
|---|---|
| 10 | portable clothes hanging rod |
| 20 | mounting plate |
| 21 | storage clip |
| 22 | pivot bracket |
| 24 | cable |
| 25 | cable crimp |
| 26 | eyelet bolt |
| 27 | upper cable loop |
| 28 | lower cable loop |
| 30 | first rod |
| 31 | rod bracket |
| 32 | rod clamping mechanism |
| 33 | second rod |
| 34 | clothes hanger grooves |
| 35 | end cap |
| 40 | fasteners |
| 41 | pivot bolt |
| 42 | pivoting movement |
| 43 | lateral movement |
| 50 | clothing/hangers |

DETAILED DESCRIPTION OF THE PREFERRED EMBODIMENT

Figure 1B:
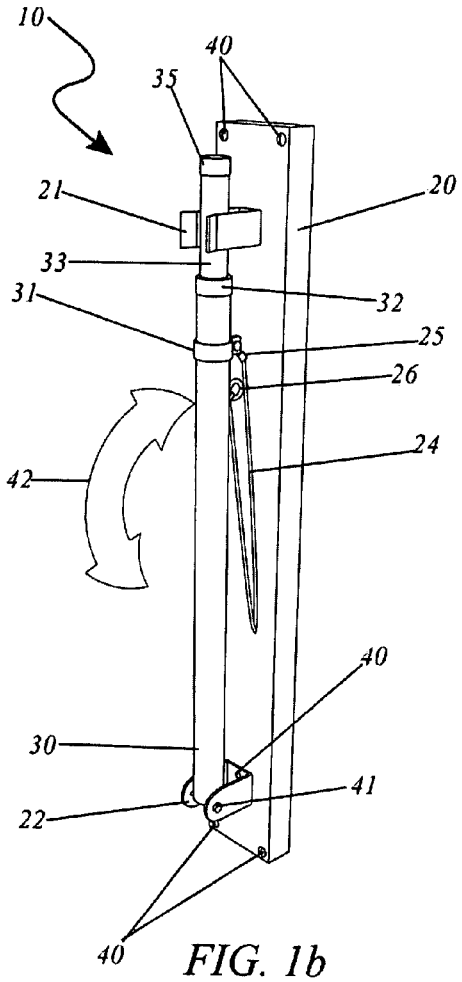
FIG. 1*b* is a perspective view of the portable clothes hanging rod 10 in a stored state, according to a preferred embodiment of the present invention; and, FIG. 2 is a close-up view of the connection portion of the portable clothes-hanging rod 10, according to a preferred embodiment of the present invention.
Figure 1A:
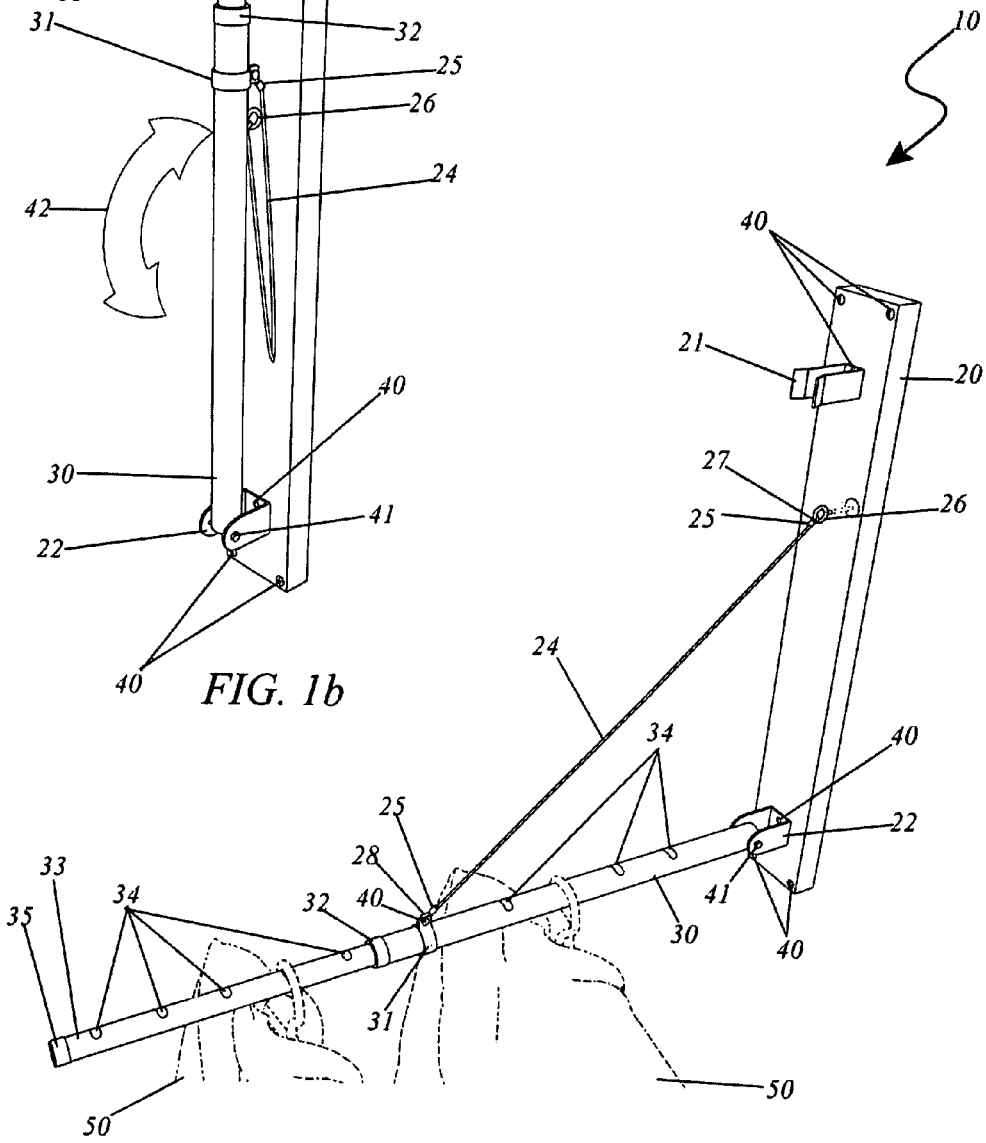
FIG. 1*a* is a perspective view of the portable clothes hanging rod 10 in a deployed state, according to a preferred embodiment of the present invention.
Figure 2:
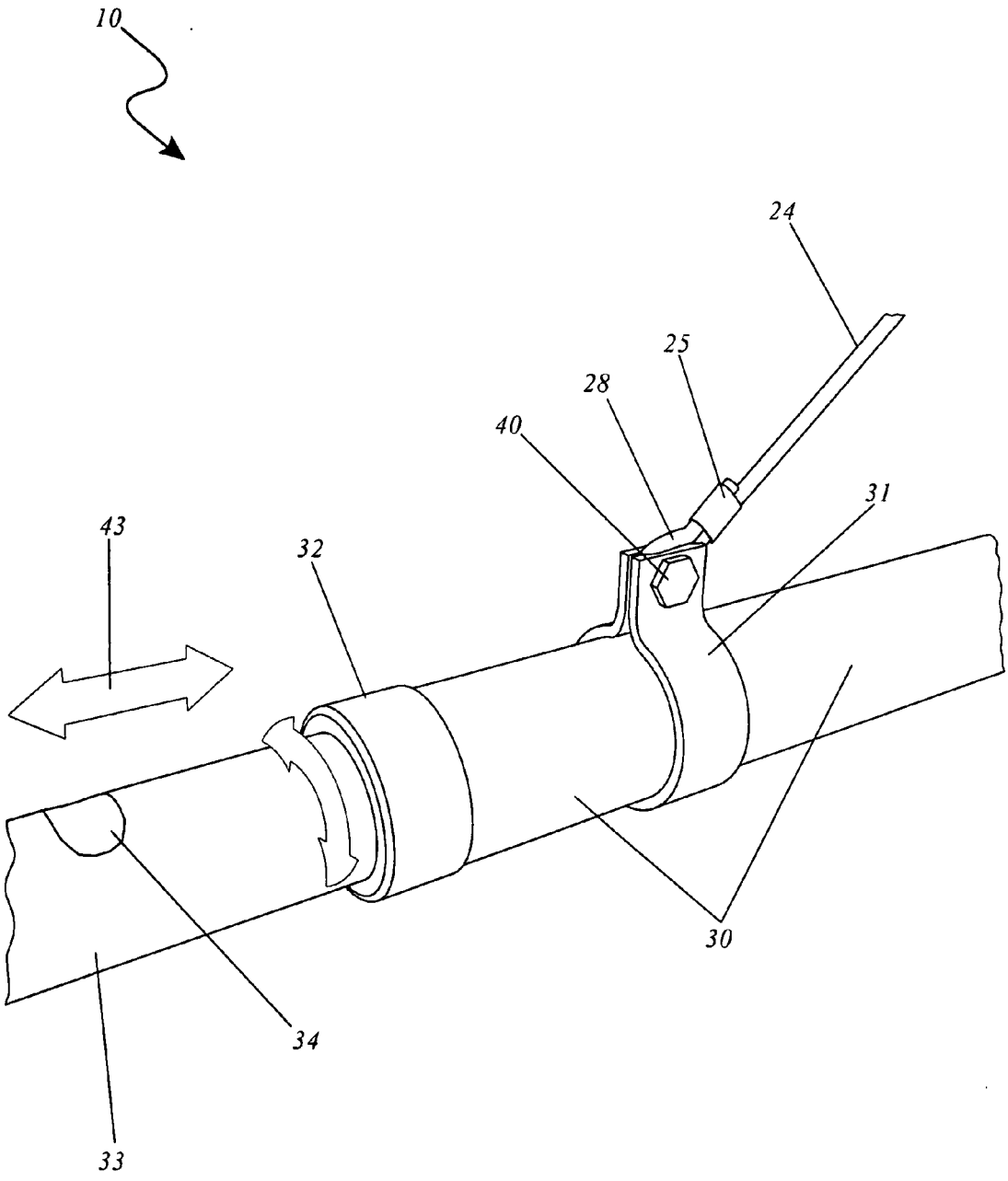

The best mode for carrying out the invention is presented in terms of its preferred embodiment, herein depicted within FIGS. 1*a* through 2. However, the invention is not limited to the described embodiment and a person skilled in the art will appreciate that many other embodiments of the invention are possible without deviating from the basic concept of the invention, and that any such work around will also fall under scope of this invention. It is envisioned that other styles and configurations of the present invention can be easily incorporated into the teachings of the present invention, and only one particular configuration shall be shown and described for purposes of clarity and disclosure and not by way of limitation of scope.

The terms "a" and "an" herein do not denote a limitation of quantity, but rather denote the presence of at least one of the referenced items.

The present invention describes an apparatus and method for a portable clothes-hanging rod (herein described as the "apparatus") 10, which provides a means for a deployable rod for hanging clothes after removal from a dryer. The apparatus 10 provides a wall-mounted plate 20 and a pair of tubular telescoping rods 30, 33 which are attached to a vertical wall surface. In a retracted state, the apparatus 10 folds compactly into a vertical position. In a deployed state, the apparatus 10 extends horizontally outward in a telescoping manner. The apparatus 10 is supported in an extended outward position by a cable 24 that extends from an outer end of a first rod 30 back to a mounting plate 20 at a 45° angle to effectively support clothing/hangers 50 and other articles.

Referring now to FIGS. 1*a* and 1*b*, perspective views of the apparatus 10 in a deployed and a stored state, respectively, according to the preferred embodiment of the present invention, are disclosed. The apparatus 10 comprises a mounting plate 20, a storage clip 21, a pivot bracket 22, a cable 24, a pair of cable crimps 25, an upper cable loop 27, a lower cable loop 28, an eyelet bolt 26, a first rod 30, a rod bracket 31, a rod clamping mechanism 32, a second rod 33, a plurality of clothes hanger grooves 34, an end cap 35, a pivot bolt 41, and a plurality of fasteners 40.

The mounting plate 20 provides an attachment means for the apparatus 10 thereto a vertical wall surface using a plurality of fasteners 40 such as screws, anchors, or the like. The mounting plate 20 comprises a rectangular base of approximately twenty-four (24) inches in length by three (3) inches wide and is envisioned being made using materials such as wood, plastic, metal, or the like. The mounting plate 20 further provides an attachment means to a storage clip 21 and a pivot bracket 22. The storage clip 21 is located at the top of the mounting plate 20 and comprises a "U"-shaped fixture providing mounting holes for attachment to the mounting plate 20 via fasteners 40 such as screws, bolts, or the like. The storage clip 21 is envisioned to be a commercially available spring type clamping fixture designed to secure vertical tubular objects. The storage clip 21 is further envisioned to be made using materials such as chrome plated steel, stainless steel, or the like.

The pivot bracket 22 is secured to a bottom portion of the mounting plate 20 using fasteners 40 such as screws, bolts, or the like. The pivot bracket 22 provides an attachment and rotation means for a first rod 30 enabling a pivoting movement 42 from the horizontal deployed state to the vertical stored state. The pivot bracket 22 is envisioned being made preferably of chrome plated steel and comprises a "U"-shape bracket having two (2) opposing vertical faces and a pivot bolt 41. The first rod 30 is attached to the pivot bolt 41 via a drilled hole. The first rod 30 comprises a metal tube approximately seventeen (17) inches in length and approximately one (1) inch in diameter. The first rod 30 provides a plurality of clothes hanger grooves 34 formed along a top surface to prevent lateral sliding of clothing/hangers 50. The first rod 30 is envisioned to be made using materials such as stainless steel tubing, chrome plated steel tubing, or the like. Also attached to the first rod 30 is a rod bracket 31 which provides an attachment means for a support cable 24 (see FIG. 2).

The second rod 33 comprises similar materials and construction as the first rod 30; however, provides a smaller diameter tubing of approximately ¾", thereby enabling the second rod 33 to be slidingly inserted with a lateral movement 43 within the first rod 30. The first rod 30 provides a telescoping and locking attachment means to the second rod 33 via a rod clamping mechanism 32 (see FIG. 2). The second rod 33 provides the capability to extend beyond the end of the first rod 30 by approximately twelve (12) inches. The second rod 33 also comprises a plurality of clothes hanger grooves 34 formed along a top surface and a plastic end cap 35.

The cable 24 provides a strong support means to hold the first rod 30 at a horizontal attitude while supporting the weight of clothing/hangers 50. The cable 24 comprises an upper cable loop 27 and a lower cable loop 28. The two (2) cable loops 27, 28 are formed into loops using cable crimps 25 common in the industry. The upper cable loop 27 is secured to the mounting plate 20 via an eyelet bolt 26 providing a threaded shank which extends through the mounting plate 20 and is secured with fasteners 40 such as a nut, washer, and the like. The lower cable loop 28 is fastened to the rod bracket 31 via the aforementioned fastener 40. The cable 24 is envisioned to be made using standard braded or stranded stainless steel wire rope having an approximate diameter of 1/16" to 1/8".

Referring now to FIG. 2, a close-up view of the connection portion of the apparatus 10, according to the preferred embodiment of the present invention, is disclosed. The connection portion of the apparatus 10 comprises a rod bracket 31, a plurality of fasteners 40, a cable 24, a lower cable loop 28, a cable crimp 25, and a rod clamping mechanism 32. The rod bracket 31 comprises a ring shaped clamping device being secured to the first rod 30 using fasteners 40 such as bolts, nuts, and the like. The rod bracket 31 is envisioned to be made using rugged materials such as fiber-filled plastic, chrome plated steel, stainless steel, or the like.

The rod clamping mechanism 32 is located at the free end of the first rod 30 and provides a bushing means between the rods 30, 33 to enhance the smooth extension of the second rod 33. The rod clamping mechanism 32 further provides a locking means to secure a desired position of the second rod 33 by providing an integral single-turn locking feature. The rod clamping mechanism 32 is envisioned to be made of injection molded plastic parts.

It is envisioned that other styles and configurations of the present invention can be easily incorporated into the teachings of the present invention, and only one particular configuration shall be shown and described for purposes of clarity and disclosure and not by way of limitation of scope.

The preferred embodiment of the present invention can be utilized by the common user in a simple and effortless manner with little or no training. After initial purchase or acquisition of the apparatus 10, it would be installed as indicated in FIGS. 1*a* and 1*b*.

The method of installing and utilizing the apparatus 10 may be achieved by performing the following steps: locating an appropriate wall surface with an inclusive wall stud on which to secure the mounting plate 20 portion of the apparatus 10; installing the apparatus 10 using the provided fasteners 40 into said wall and stud; deploying the first rod 30 by releasing and pivoting said first rod 30 downward in a pivoting movement 42 from the storage clip 21 until the cable 24 is taut; releasing the rod clamping mechanism 32 by rotating the second rod 33 one full turn in a counter-clockwise direction; extending the second rod 33 outward in a lateral movement 43 until obtaining a desired length; securing the position of the second rod 33 by rotating one full turn in a clockwise direction; loading clothing/hangers 50 onto the first rod 30 and second rod 33 using the clothes hanger grooves 34; storing the apparatus 10 after drying and removal of the clothing/hangers 50 by retracting and pivoting the rods 30, 33 to the vertical stored state; and, enjoying the quick deployment, storage, and space-saving benefits of the present invention 10.

The foregoing descriptions of specific embodiments of the present invention have been presented for purposes of illustration and description. They are not intended to be exhaustive or to limit the invention and method of use to the precise forms disclosed. Obviously many modifications and variations are possible in light of the above teaching. The embodiment was chosen and described in order to best explain the principles of the invention and its practical application, and to thereby enable others skilled in the art to best utilize the invention and various embodiments with various modifications as are suited to the particular use contemplated. It is understood that various omissions or substitutions of equivalents are contemplated as circumstance may suggest or render expedient, but is intended to cover the application or implementation without departing from the spirit or scope of the claims of the present invention.

What is claimed is:

1. A portable clothes-hanging rod comprising:

a wall-mounted plate attached to a vertical support surface;

a pair of telescoping rods pivotally attached to said mounting plate, wherein said pair of telescoping rods comprises a first rod having a pair of holes formed in an inner end thereof and a second rod;

a rod clamping means rotatably attached to an outer surface of an outer end of said first rod, further comprising a bushing means to provide a smooth extension of said second rod therefrom said first rod and a securing means to secure a desired position of said second rod;

a cable having opposed top and bottom ends respectively, said top end of said cable being attached to said mounting plate while said bottom end of said cable is attached to said first rod of said pair of telescoping rods;

a storage clip attached to an inner surface of said mounting plate, said storage clip being located adjacent to a top end of said mounting plate and extending away therefrom;

a pivot bracket attached to said inner surface of said mounting plate, said pivot bracket being located adjacent to a bottom end of said mounting plate and having a pair of laterally opposed tabs extending outwardly therefrom, each of said tabs having a bore formed therein, each of said bores having a centrally registered axis oriented perpendicular to a longitudinal length of said mounting plate;

a pair of cable crimps integrally attached to said respective top and bottom ends of said cable such that each of said crimps cooperates with each of said top and bottom ends respectively of said cable to form an upper cable loop and a lower cable loop respectively;

said top end of said cable being attached to said mounting plate via an eyelet bolt statically connected to said inner surface of said mounting plate and extending away therefrom, said eyelet bolt being located subjacent to said storage clip, said upper cable loop of said cable being slidably attached to said eyelet bolt; and, said bottom end of said cable is attached to said first rod of said pair of telescoping rods via a rod bracket statically affixed to said outer surface of said first rod, said rod bracket being located adjacent to said outer end of said first rod, said lower cable loop of said cable being removably attached directly to said rod bracket;

wherein said clothes-hanging rod folds into a vertical position when in a retracted state and extends horizontally outward in a telescoping manner when in a deployed state, said clothes-hanging rod being supported in said deployed state by said cable extending from said outer end of said first rod of said pair of telescoping rods back to said mounting plate at a 45° angle to support existing clothing and hangers and other articles respectively thereon.

2. The portable clothes-hanging rod of claim 1, further comprising:

said second rod thereof said pair of telescoping rods telescopically connected to said first rod, said second rod having a diameter that is less than a diameter of said first rod such that said second rod is telescopically interfitted within said first rod, said second rod being prohibited from prematurely and undesirably shifting during operating conditions via manipulation of said rod clamping means;

a plurality of clothes hanger grooves monolithically formed in an outer surface of said second rod and said outer surface of said first rod respectively, said grooves being equidistantly spaced along respective longitudinal lengths of said first and second rods;

an end cap removably interfitted over a distal end of said second rod such that said end cap prohibits said second rod from being completely interfitted within said first rod;

a pivot bolt removably and simultaneously penetrated through said bores of said pair of laterally opposed tabs and said holes of said inner end of said first rod such that said inner end of said first rod is pivotally attached to said pivot bracket, said first and second rods respectively being simultaneously biased upwardly and downwardly respectively 45 degrees along an arcuate path defined by the pivot point of said pivot bracket;

wherein said first and second rods simultaneously reside along the vertical plane when in the retracted state and alternately simultaneously reside along the horizontal plane when in the deployed state; and, a plurality of fasteners for removably fastening said mounting plate to a vertical support surface and said storage clip and said pivot bracket respectively to said inner surface of said mounting bracket and said lower cable loop to said rod bracket respectively.

3. The portable clothes-hanging rod of claim 2, wherein said storage clip comprises:

a "U"-shaped body provided with a closed end connected directly to said inner surface of said mounting plate, said storage clip having an open end extending outwardly and away from said closed end of said storage clip, said open end of said storage clip receiving and capturing said distal end of said second rod when said first rod and said second rod are simultaneously biased to the vertical position when said portable clothes-hanging rod is in the retracted state.

4. The portable clothes-hanging rod of claim 3, wherein said cable provides support means for holding said first and second rods respectively along the horizontal plane while supporting the weight of clothing and hangers thereon when said portable clothes-hanging rod is in the deployed state, said cable extending between said eyelet bolt and said rod bracket respectively.

5. The portable clothes-hanging rod of claim 4, wherein said securing means of said rod clamping means further comprises a single-turn locking feature.

6. A portable clothes-hanging rod comprising:

a rectilinear wall-mounted plate attached to a vertical support surface;

a pair of tubular telescoping rods pivotally attached to said mounting plate, wherein said pair of tubular telescoping rods comprises a first rod comprising a pair of diametrically opposed holes formed in an inner end thereof and a second rod;

a rod clamping means rotatably attached to an outer surface of an outer end of said first rod, further comprising a bushing means to provide a smooth extension of said second rod therefrom said first rod and a securing means to secure a desired position of said second rod;

a flexible cable having opposed top and bottom ends respectively, said top end of said cable being attached to said rectilinear wall-mounted plate while said bottom end of said cable is attached to said first rod of said pair of tubular telescoping rods;

a storage clip attached to an inner surface of said rectilinear wall-mounted plate, said storage clip being located adjacent to a top end of said rectilinear wall-mounted plate and extending away therefrom;

a pivot bracket attached to said inner surface of said rectilinear wall-mounted plate, said pivot bracket being located adjacent to a bottom end of said rectilinear wall-mounted plate and having a pair of laterally opposed tabs extending outwardly therefrom, each of said tabs having a bore formed therein, each of said bores having a centrally registered axis oriented perpendicular to a longitudinal length of said rectilinear wall-mounted plate;

a pair of cable crimps integrally attached to said respective top and bottom ends of said cable such that each of said crimps cooperates with each of said top and bottom ends respectively of said cable to form an upper cable loop and a lower cable loop respectively;

said top end of said cable being attached to said rectilinear wall-mounted plate via an eyelet bolt statically connected to said inner surface of said rectilinear wall-mounted plate and extending away therefrom, said eyelet bolt being located subjacent to said storage clip, said upper cable loop of said cable being slidably attached to said eyelet bolt; and, said bottom end of said cable is attached to said first rod of said pair of tubular telescoping rods via a rod bracket statically affixed to said outer surface of said first rod, said rod bracket being located adjacent to said outer end of said first rod, said lower cable loop of said cable being removably attached directly to said rod bracket;

wherein said clothes-hanging rod folds into a vertical position when in a retracted state and extends horizontally outward in a telescoping manner when in a deployed state, said clothes-hanging rod being supported in said deployed state by said cable extending from said outer end of said first rod of said pair of telescoping rods back to said mounting plate at a 45° angle to support existing clothing and hangers and other articles respectively thereon.

7. The portable clothes-hanging rod of claim 6, further comprising:

said second rod thereof said pair of telescoping rods telescopically connected to said first rod, said second rod having a diameter that is less than a diameter of said first rod such that said second rod is telescopically interfitted within said first rod, said second rod being prohibited from prematurely and undesirably shifting during operating conditions via manipulation of said rod clamping means;

a plurality of clothes hanger grooves monolithically formed in an outer surface of said second rod and said outer surface of said first rod respectively, said grooves being equidistantly spaced along respective longitudinal lengths of said first and second rods;

an end cap removably interfitted over a distal end of said second rod such that said end cap prohibits said second rod from being completely interfitted within said first rod;

a pivot bolt removably and simultaneously penetrated through said bores of said pair of laterally opposed tabs and said holes of said inner end of said first rod such that said inner end of said first rod is pivotally attached to said pivot bracket, said first and second rods respectively being simultaneously biased upwardly and downwardly respectively 45 degrees along an arcuate path defined by the pivot point of said pivot bracket;

wherein said first and second rods simultaneously reside along the vertical plane when in the retracted state and alternately simultaneously reside along the horizontal plane when in the deployed state; and, a plurality of fasteners for removably fastening said mounting plate to a vertical support surface and said storage clip and said pivot bracket respectively to said inner surface of said mounting bracket and said lower cable loop to said rod bracket respectively.

8. The portable clothes-hanging rod of claim 7, wherein said storage clip comprises:

a "U"-shaped body provided with a closed end connected directly to said inner surface of said rectilinear wall-mounted plate, said storage clip having an open end extending outwardly and away from said closed end of said storage clip, said open end of said storage clip receiving and capturing said distal end of said second rod when said first rod and said second rod are simultaneously biased to the vertical position when said portable clothes-hanging rod is in the retracted state.

9. The portable clothes-hanging rod of claim 8, wherein said cable provides a support means for holding said first and second rods respectively along the horizontal plane while supporting the weight of clothing and hangers thereon when said portable clothes-hanging rod is in the deployed state, said cable extending between said storage clip and said rod bracket respectively.

10. The portable clothes-hanging rod of claim 9, wherein said securing means of said rod clamping means further comprises a single-turn locking feature.

* * * * *